US009770911B2

(12) United States Patent
Inada et al.

(10) Patent No.: US 9,770,911 B2
(45) Date of Patent: Sep. 26, 2017

(54) LIQUID EJECTION HEAD AND LIQUID EJECTION APPARATUS WITH BEAM-SHAPED MEMBERS IN FLOW PASSAGE

(71) Applicant: CANON KABUSHIKI KAISHA, Tokyo (JP)

(72) Inventors: Genji Inada, Koshigaya (JP); Hiromasa Amma, Kawasaki (JP); Takuya Iwano, Inagi (JP); Chiaki Muraoka, Kawaguchi (JP); Tokuji Kudo, Kawasaki (JP); Shimpei Yoshikawa, Yokohama (JP); Monta Matsui, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/160,167

(22) Filed: May 20, 2016

(65) Prior Publication Data

US 2016/0347073 A1 Dec. 1, 2016

(30) Foreign Application Priority Data

May 27, 2015 (JP) ..... 2015-107269

(51) Int. Cl.

| | |
|---|---|
| ***B41J 2/175*** | (2006.01) |
| ***B41J 29/02*** | (2006.01) |
| *B41J 2/19* | (2006.01) |

(52) U.S. Cl.

CPC ..... *B41J 2/175* (2013.01); *B41J 2/17509* (2013.01); *B41J 2/17513* (2013.01); *B41J 2/17553* (2013.01); *B41J 29/02* (2013.01); *B41J 2/19* (2013.01)

(58) Field of Classification Search

CPC . B41J 2/175; B41J 2/19; B41J 2/17513; B41J 2/17553; B41J 2/17556; B41J 2/17563

See application file for complete search history.

(56) References Cited

U.S. PATENT DOCUMENTS

| | | | | |
|---|---|---|---|---|
| 6,095,639 | A | 8/2000 | Uetsuki et al. | |
| 6,467,882 | B2 | 10/2002 | Inui et al. | |
| 6,540,343 | B1 | 4/2003 | Umeyama et al. | |
| 7,628,469 | B2 * | 12/2009 | Inoue | B41J 2/1404 347/56 |
| 8,087,759 | B2 | 1/2012 | Oikawa et al. | |
| 8,210,655 | B2 | 7/2012 | Muraoka et al. | |
| 8,998,375 | B2 | 4/2015 | Amma et al. | |
| 9,248,650 | B2 | 2/2016 | Muraoka et al. | |

FOREIGN PATENT DOCUMENTS

JP 2011-079246 A 4/2011

* cited by examiner

*Primary Examiner* — Juanita D Jackson

(74) *Attorney, Agent, or Firm* — Fitzpatrick, Cella, Harper & Scinto

(57) ABSTRACT

In a liquid ejection head and a liquid ejection apparatus that can suppress deterioration of image quality, a plurality of second beam-shaped member is provided on the downstream side of a first beam-shaped member in a flow passage connected to an ejection element substrate. The first beam-shaped member divides the flow passage into two flow passages in a liquid-flowing direction and the second beam-shaped member sandwich a line extending from the first beam-shaped member in the liquid-flowing direction.

7 Claims, 7 Drawing Sheets

LIQUID EJECTION HEAD AND LIQUID EJECTION APPARATUS WITH BEAM-SHAPED MEMBERS IN FLOW PASSAGE

BACKGROUND OF THE INVENTION

Field of the Invention

The present invention relates to a liquid ejection head used in a liquid ejection apparatus, and the liquid ejection apparatus.

Description of the Related Art

In the liquid ejection head, there are cases where ejected bubbles are generated from the vicinity of an ejection port along with ejection. The ejected bubbles generated along with ejection float in a flow passage with the aid of their own buoyancy and remain above the flow passage. In the case where the flow rate of liquid in the flow passage is increased by an ejecting operation, the velocity of the liquid in the flow passage is increased, and small bubbles derived from the ejected bubbles which remain above the flow passage are carried away by the flow and fall downward toward an ejection element substrate. In the case where the small bubbles which have fallen downward in this way reach an ejection port, the small bubbles sometimes generate non-ejection of not ejecting the liquid. In a case where generation places and generation timing of nonejection are randomly distributed, it is difficult to visually confirm such nonejection, and thus nonejection may rarely deteriorate sensory image quality.

In liquid ejection heads that supply the liquid to the ejection element substrate provided with a comparatively long ejection port array, there is a liquid ejection head having a long-hole flow passage which guides the liquid to a long hole-like liquid supply port of the ejection element substrate and which is widely opened in a long-hole shape. Such a structure makes it possible to supply a large amount of liquid simultaneously and uniformly to the entire ejection element substrate in comparison with a structure of a flow passage accompanied with a steep throttle directly upstream of the ejection element substrate.

In Japanese Patent Laid-Open No. 2011-079246, there is disclosed a liquid ejection head in which a beam-shaped member is provided in the flow passage for reinforcement and the like in order to prevent deformation in the process of manufacturing the long-hole flow passage.

There are cases where flow velocities are different from each other between one side and the other side of the long-hole flow passage in a longitudinal direction depending on the structure of the liquid ejection head. In a case where the beam-shaped member is provided in the flow passage and a difference in flow velocities between the flow passages on the both sides of the beam-shaped member is large as that in Japanese Patent Laid-Open No. 2011-079246, a flow directed from a high-velocity flow passage toward a low-velocity flow passage is generated at a downstream-side terminal of the beam-shaped member.

At this time, also the small bubbles having fallen downward together with the flow of the liquid are carried away toward the low-velocity flow passage side. However, in many cases, the small bubbles are sucked into a flow directed toward the ejection port of the ejection element substrate in the case of passing through the downstream-side terminal of the beam-shaped member. Therefore, there are cases where nonejection frequently occurs in the ejection port located directly under the beam-shaped member and causes deterioration of the image quality.

SUMMARY OF THE INVENTION

Therefore, the present invention aims to provide a liquid ejection head and a liquid ejection apparatus which make it possible to suppress deterioration of the image quality.

According to the present invention, there is provided a liquid ejection head including: an ejection element substrate configured to eject liquid; and a flow passage configured to guide the liquid to the ejection element substrate, wherein the flow passage includes a first beam-shaped member configured to divide the flow passage into a plurality of flow passages and a plurality of second beam-shaped members which are provided on a downstream side of the first beam-shaped member in a liquid-flowing direction so as to sandwich a line extending the first beam-shaped member in the liquid-flowing direction.

According to the present invention, it is possible to achieve the liquid ejection head and the liquid ejection apparatus which make it possible to suppress deterioration of the image quality.

Further features of the present invention will become apparent from the following description of exemplary embodiments (with reference to the attached drawings).

DESCRIPTION OF THE EMBODIMENTS (First Embodiment)

Hereinafter, the first embodiment of the present invention will be described with reference to the drawings.

Figure 1:
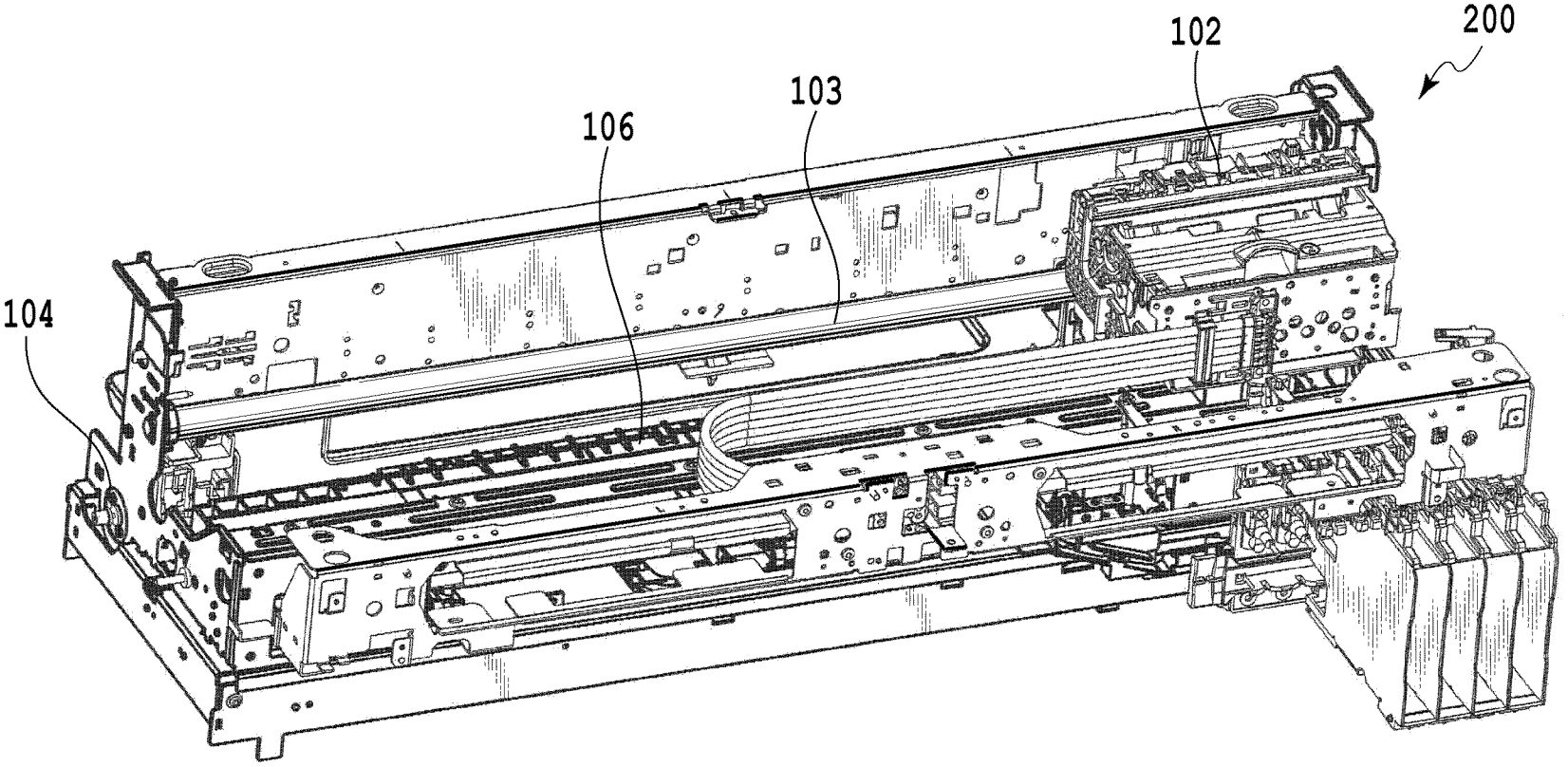
FIG. 1 is a perspective view illustrating a liquid ejection apparatus.

FIG. 1 is a perspective view illustrating a liquid ejection apparatus 200 to which the present invention is applicable. A carriage 102 on which a liquid ejection head is to be mounted is supported to be reciprocally movable along a guide 103 extending in a main scanning direction. The carriage 102 to which a liquid supply tube has been connected is driven by a carriage motor (not illustrated).

A printing medium such as a sheet of paper is fed by a sheet feed roller (not illustrated) driven by a sheet feed motor (not illustrated) of a sheet feed mechanism via a gear train, and is sent out onto a platen 106 by a conveying roller 104 and a pinch roller (not illustrated). Liquid is ejected from an ejection port of the liquid ejection head and printing is performed on the printing medium which is conveyed on the platen 106 by the conveying roller 104 and a sheet discharge roller (not illustrated).

In the case of performing printing on the printing medium, the carriage 102 is accelerated from a stopped state, and then is moved at a constant speed throughout a scanning range for a printing operation. At this time, the liquid is ejected from the ejection port of the liquid ejection head onto the printing medium to thereby form an image on the printing medium. After printing for one line has been completed by performing one time or a plurality of times of scanning, the carriage 102 is decelerated and comes to a standstill. Then, the printing medium is fed by a predetermined amount by rotation of the conveying roller 104 and the sheet discharge roller.

Figure 2:
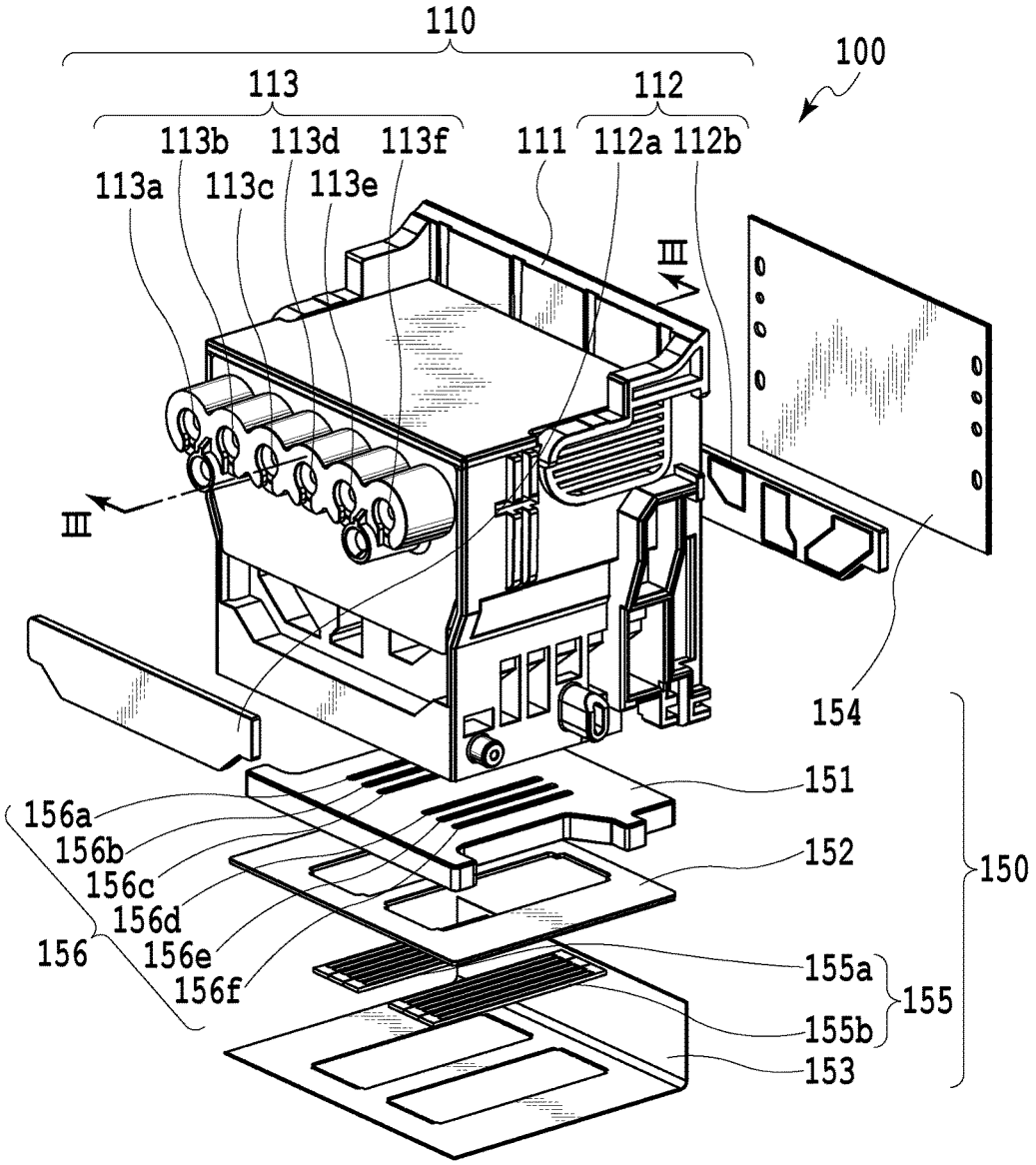
FIG. 2 is an exploded perspective view illustrating a liquid ejection head.

FIG. 2 is an exploded perspective view illustrating a liquid ejection head 100 according to the first embodiment. The liquid ejection head 100 includes a liquid supply unit 110, an ejection element unit 150 for accepting supply of the liquid from the liquid supply unit 110 and ejecting the liquid onto the printing medium. The liquid ejection head 100 is fixedly supported on the carriage 102 by a positioning unit and an electric contact of the carriage 102 provided in the liquid ejection apparatus (not illustrated) and is made to be detachable relative to the carriage 102.

The liquid ejection apparatus 200 is provided with a liquid supply tube connected with a liquid tank (not illustrated), and a leading end of the liquid supply tube is provided with a liquid connector. In the case where the liquid ejection head 100 is mounted, the liquid connector and a liquid connector insertion port 113 are air-tightly connected together and the liquid in the liquid tank is supplied to the liquid ejection head 100. In the present embodiment, the liquid ejection head 100 is one capable of mounting six kinds of liquid, liquid connector insertion ports 113*a* to 113*f* are provided respectively corresponding to the liquid supply tubes, and supply paths are individually formed.

The ejection element unit 150 includes two ejection element substrates 155*a* and 155*b*, a first support member 151, a second support member 152, an electric wiring tape 153, an electric contact substrate 154. Although, in the present embodiment, the first support member 151 and the second support member 152 are made of calcined alumina, the first support member 151 and the second support member 152 may be formed by a resin mold similarly to a housing 111.

An ejection element substrate 155 of the ejection element unit 150 includes an energy generation element which generates energy utilized for ejecting the liquid onto one surface of a Si substrate having a thickness of 0.5 to 1 mm. In the present embodiment, a plurality of heaters is used as the energy generation element, and electric wiring which supplies electric power to each heater is formed by a film deposition technology. Then, a plurality of liquid flow passages and a plurality of ejection ports which respectively correspond to the heaters are formed by a photolithographic technology, and ejection port liquid chambers (not illustrated) are formed so as to be opened to the back surface in order to supply the liquid to the plurality of liquid flow passages. Note that the energy generation element used may be a piezoelectric element.

The second support member 152 having an opening for the ejection element substrate is adhesively fixed to the first support member 151, and the electric wiring tape 153 is held so as to be electrically connected to an ejection element substrate 155 (155*a*, 155*b*) via the second support member 152. The electric wiring tape 153 is adapted to apply an electric signal for ejecting the liquid to the ejection element substrate 155. An electric contact substrate 154 which includes an external signal input terminal adapted to receive the electric signal from the liquid ejection apparatus 200 is thermally crimped and electrically connected to an end of the electric wiring tape 153, by using an anisotropic electroconductive film (not illustrated).

The ejection element substrate 155 is adhesively fixed to the first support member 151 which includes a liquid supply port 156. Six liquid supply ports 156*a* to 156*f* are formed in the first support member 151, and the liquid supply ports 156*a* to 156*f* are respectively connected with third liquid chambers 123*a* to 123*f* provided in the housing 111.

Figure 3:
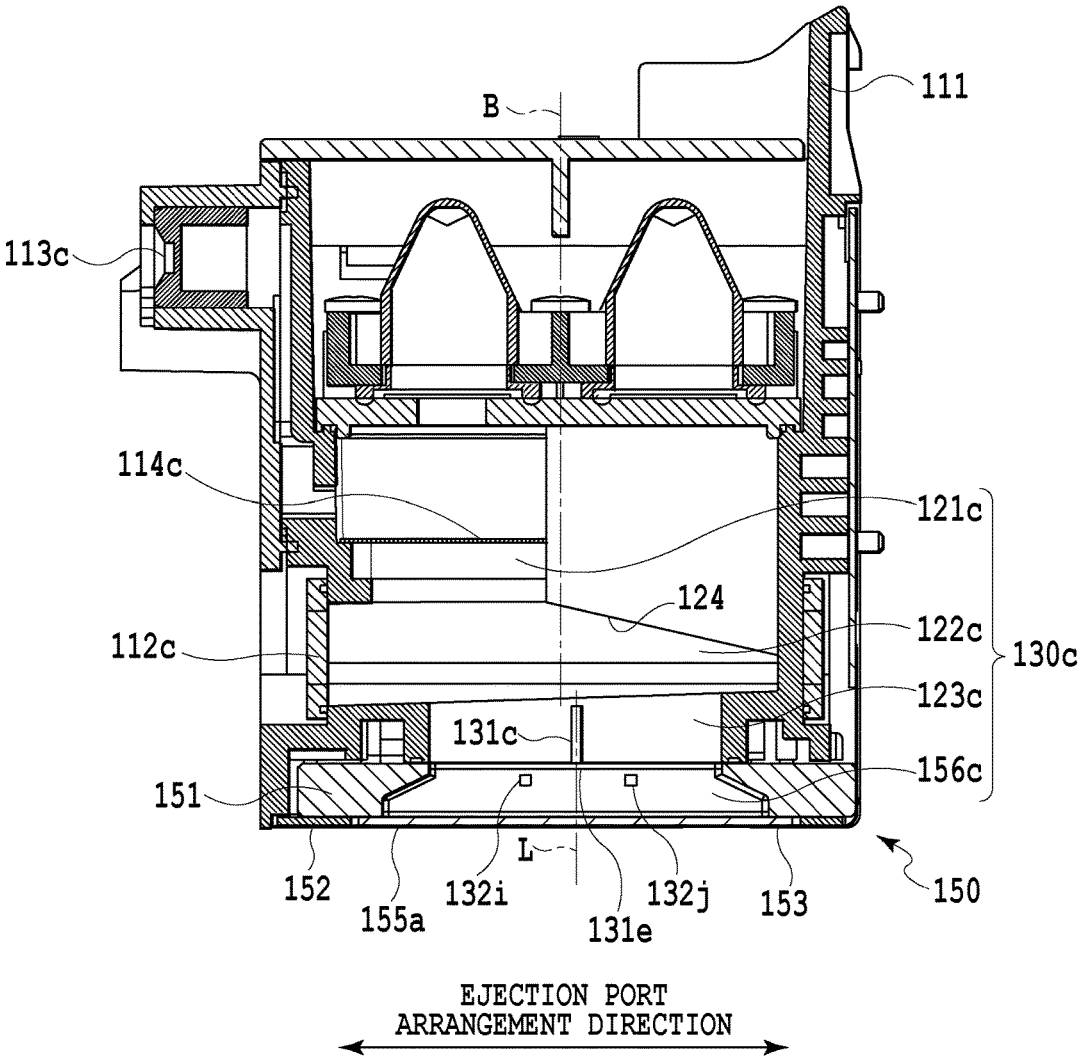
FIG. 3 is a cross-sectional diagram taken along in FIG. 2.

FIG. 3 is a cross-sectional diagram taken along III-III in FIG. 2 illustrating liquid supply from the liquid connector insertion port 113*c* to the ejection element unit 150. Other five liquid supply systems such as a liquid supply system which includes the liquid connector insertion port 113*a* have the same structures as the above. The liquid supplied from the liquid connector insertion port 113*c* passes through a filter 114*c* which prevents mixing of foreign substances into the ejection port, and is supplied to the ejection element unit 150 through a first liquid chamber 121*c*, a second liquid chamber 122*c* and the third liquid chamber 123*c*. Resin molded parts are adopted as the housing 111 and a lid member 112.

The first liquid chamber 121*c*, the second liquid chamber 122*c*, the third liquid chamber 123*c* and the liquid supply port 156*c* are all flow passages which are arranged in long hole shapes in an ejection port arrangement direction and form a long-hole communication flow passage 130*c* by mutually communicating them. The communication flow passage 130*c* is a deviated supply path in which the center of a long-hole flow passage located directly downstream of the filter 1146*c* shifts in the ejection port arrangement direction of the ejection element substrate 155*a*. An amount of deviation of the deviated supply path is determined in accordance with a size of the liquid ejection head 100 and a layout of supply paths for the liquid of a plurality of colors.

In addition, a flow passage (not illustrated) located adjacent to the communication flow passage 130*c* has a structure in which the left and the right are reversed relative to an almost central axis B-B in FIG. 3. Accordingly, the respective flow passages are densely arranged, and miniaturization of the liquid ejection head is achieved. A slope 124 is for preventing stagnation of liquid flows and the small bubbles in the communication flow passage 130*c*, and has a structure in which the slope is preferably provided in the deviated supply path.

Figure 4:
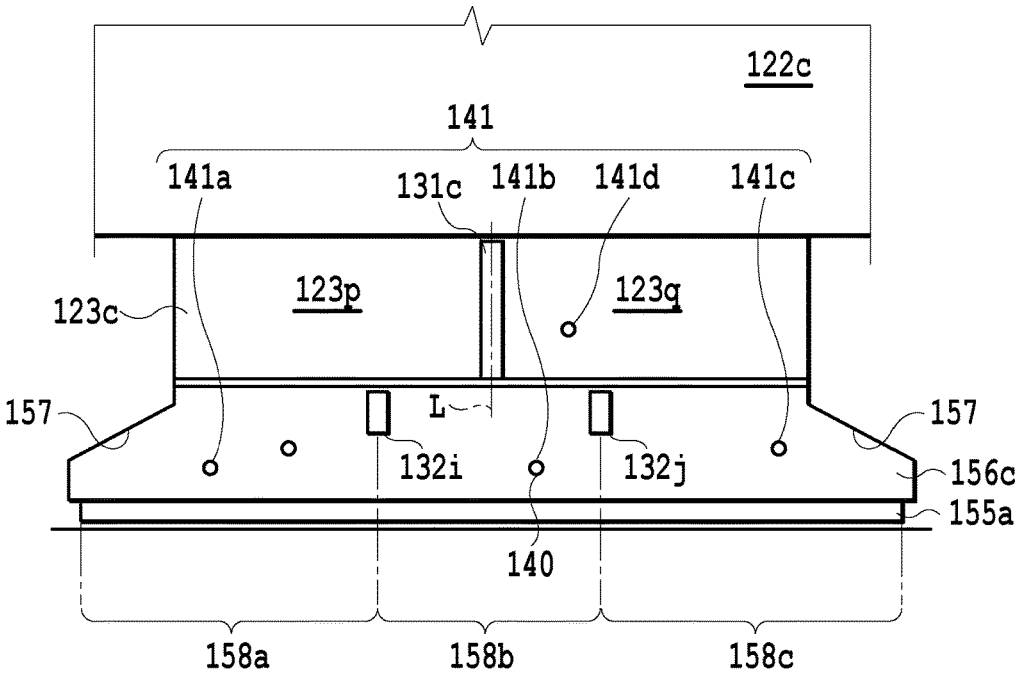
FIG. 4 is a diagram illustrating a flow passage region in which a first beam-shaped member and a second beam-shaped member are provided.

FIG. 4 is a diagram illustrating a flow passage region where a first beam-shaped member and a second beam-shaped member of the liquid ejection head 100 according to the present embodiment are provided. The beam-shaped members are respectively provided in the liquid chamber 123*c* and the liquid supply port 156*c*. A first beam-shaped member 131*c* extending from the upstream (the filter side) to the downstream (the ejection element side) of the flow passage in the liquid chamber 123*c* is arranged approximately at a central part in a width direction of the liquid chamber 123*c* of about 26 mm in width in the ejection port arrangement direction. Consequently, the liquid chamber 123*c* is divided into two chambers of a left-side liquid chamber 123*p* and a right-side liquid chamber 123*q* of the beam-shaped member 131*c*. The left liquid chamber 123*p* is located on the side where the filter 114*c* is provided, and is a deviated-side flow passage.

In addition, the right liquid chamber 123*q* is located on the side where the filter 114*c* is not provided, and is a reversely-deviated-side flow passage. The liquid which has flown into the second liquid chamber 122*c* from the oblique upper left-hand side in the drawing is supplied to the third liquid chamber 123*c* through the second liquid chamber 122*c*. The flow of the liquid is partially regulated by the beam-shaped member 131*c* which vertically extends, and the liquid reaches the ejection element substrate 155*a*.

One set of second beam-shaped members 132*i* and 132*j* is provided in the vicinity of a joint section between the support member 151 of a liquid supply port 156*c* and the housing 111 at intervals of about 10 mm so as to sandwich an extension line L of the first beam-shaped member 131*c*.

The first beam-shaped member 131*c* is arranged at a central part of the liquid chamber 123*c* which is favorable for reinforcement as a reinforcement member for preventing deformation of the resinous liquid chamber 123*c* in resin molding into a long-hole shape. On the other hand, the second beam-shaped members 132*i* and 132*j* are provided as reinforcement members against deformation in alumina calcination. It is advantageous to reduce the number of the beam-shaped members 132 from the viewpoint of reducing flow resistance in the liquid supply port 156*c* by providing the second beam-shaped members. However, a problem is generated in the case of one beam-shaped member 132. Regarding the point, description will be made in a later-described comparative example.

Next, the behavior of small bubbles 140 in the flow passage during ejection according to the present embodiment will be described.

The small bubbles 140 derived from ejected bubbles generated from the ejection port along with ejection float in the communication flow passage 130*c* with the aid of the buoyancy, and are accumulated by floating above the first liquid chamber 121*c* which is located downstream of the filter 114*c* with the aid of a meniscus stretched over the filter 114*c*. Some of them are accumulated also in the second liquid chamber 122*c*. In a case where the flow rate in the communication flow passage 130*c* in ejection is comparatively small, the small bubbles remain above the first liquid chamber 121*c* and the like. However, in the case where the flow rate of the liquid flowing through the communication flow passage 130*c* is increased in high-speed ejection and force of pushing the small bubbles downstream exceeds the flow power of the small bubbles 140, the small bubbles 140 fall downward toward the downstream through a path such as a flow 141. The number of the small bubbles carried toward the downstream becomes larger as the flow velocity becomes larger.

In case of the liquid supply unit 110 including the deviated supply path as in the present embodiment, even in a case where there is no particular deviation in ejection distribution of liquid droplets ejected from the ejection ports which are arranged just like a belt-shaped pattern in the ejection port arrangement direction, the flow rate in the deviated side flow passage becomes larger than the flow rate in the reversely deviated side flow passage in the deviated flow passage. Accordingly, also the flow velocity becomes higher in the deviated side flow passage. That is, in the third liquid chamber 123*c*, the flow velocity in the left liquid chamber 123*p* becomes higher than the flow velocity in the right liquid chamber 123*q*. Therefore, a larger number of the small bubbles fall downward in the left liquid chamber 123*p* than in the right liquid chamber 123*q*.

The liquid flowing through the left liquid chamber 123*p* is divided into two flows 141*a* and 141*b* by the beam-shaped member 132*i*. In the two flows, one flow 141*b* merges with a flow 141*d* from the right liquid chamber 123*q* directly under a lower end of a beam-shaped member 131*c*, and flows through a region 158*b* between the beam-shaped member 132*i* and the beam-shaped member 132*j* of the liquid supply port 156*c* by more reducing the flow velocity than that of the flow in the left liquid chamber 123*p*. The other flow 141*a* in the left liquid chamber 123*p* passes on the left side of the beam-shaped member 132*i* and reduces its flow velocity due to a spread 157 at an end of the liquid supply port 156*c*.

The liquid flowing through the right liquid chamber 123*q* is divided into two flows 141*c* and 141*d* by the beam-shaped member 132*j*. In the two flows, one flow 141*d* merges with the flow 141*b* from the left liquid chamber 123*p* flowing under the beam-shaped member 131*c*, and flows through the region 158*b* between the beam-shaped member 132*i* and the beam-shaped member 132*j* of the liquid supply port 156*c* by more increasing the flow velocity than that of the flow in the right liquid chamber 123*q*. The other flow 141*c* of the liquid in the right liquid chamber 123*q* passes on the left side of the beam-shaped member 132*j* and reduces its flow velocity due to the spread 157 at the end of the liquid supply port 156*c*.

As a result, a difference in flow velocity between adjacent regions in three regions 158*a*, 158*b* and 158*c* of the liquid supply port 156*c* divided by the beam-shaped members 132*i* and 132*j* is made smaller than the difference in flow velocity of the liquid between the left liquid chamber 123*p* and the right liquid chamber 123*q*. Since the difference in flow velocity between the adjacent regions is small, almost no flow of the liquid flowing between the respective regions is generated in parts at the lower end portions of the beam-shaped member 132*i* and the beam-shaped member 132*j*. Consequently, the small bubbles 140 carried to the three regions of the liquid supply port 156*c* are distributedly carried to the vicinity of the ejection ports via ejection port liquid chambers located downstream of the respective regions without concentrating on the parts under the beam-shaped members.

The amount of the small bubbles carried from each of the left and right liquid chambers of the beam-shaped member 131 to the region 158*b* is changed depending on the flow rate in each of the left and right liquid chambers of the third liquid chamber 123*c*, associated with details of ejection. Supposing that the liquid droplets are continuously ejected from all of the ejection ports, the flow rate in the left liquid chamber 123*p* is larger than that in the right liquid chamber 123*q*. In addition, the flow rate of the liquid flowing from the left liquid chamber 123*p* into the region 158*b* is larger than the flow rate of the liquid flowing from the right liquid chamber 123*q* into the region 158*b*. Therefore, the amount of the small bubbles carried from the left liquid chamber 123*p* into the region 158*b* becomes larger than that of the small bubbles carried from the right liquid chamber 123*q* into the region 158*b*.

As described above, the small bubbles carried to the liquid supply port 156*c* fall downward by being distributed in the three regions divided by one set of beam-shaped members 132, thereby not concentrating on a specific place. Accordingly, although there is the possibility that the fallen small bubbles may jump into the ejection ports, the places are distributed in the ejection port arrangement direction, and thus a visible ejection failure is hardly generated.

Figure 5A:
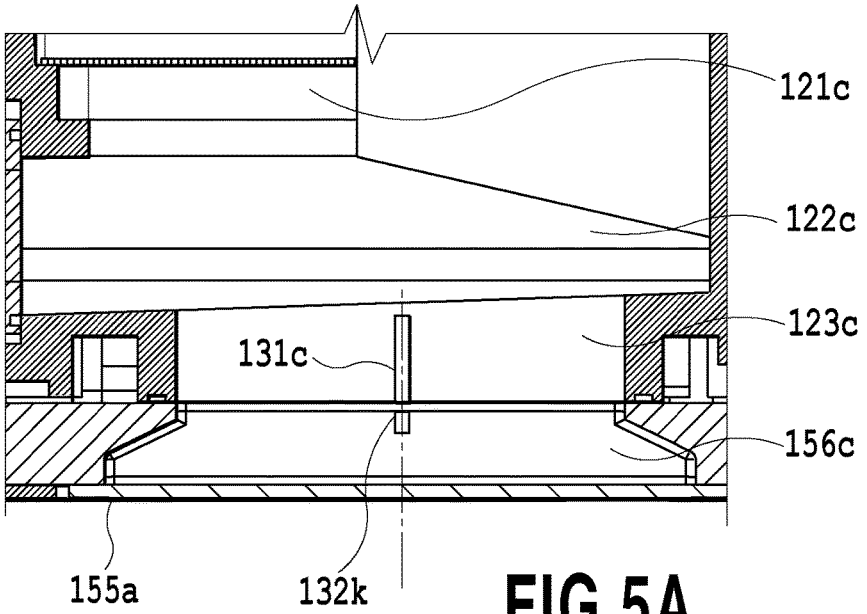
FIG. 5A is a diagram illustrating a flow passage region of a comparative example.

FIG. 5A is a diagram illustrating a flow passage region in which the beam-shaped member of a liquid ejection head of a comparative example of the present embodiment is provided. In the liquid ejection head of the comparative example, the reinforcement beam-shaped member 131 to be provided in the third liquid chamber 123*c* has the same structure as the liquid ejection head according to the embodiment of the present invention in FIG. 4 and one beam-shaped member 132*k* is provided in the liquid supply port 156*c* apart from the ejection element substrate 155*a* by the distance which is the same as that in the example in FIG. 4. The beam-shaped member 132*k* is provided at a central part of the liquid supply port 156*c* which is a favorable position for preventing deformation of the long-hole liquid supply port 156*c* by one beam-shaped member, that is, directly downstream of the beam-shaped member 131*c*.

Figure 5B:
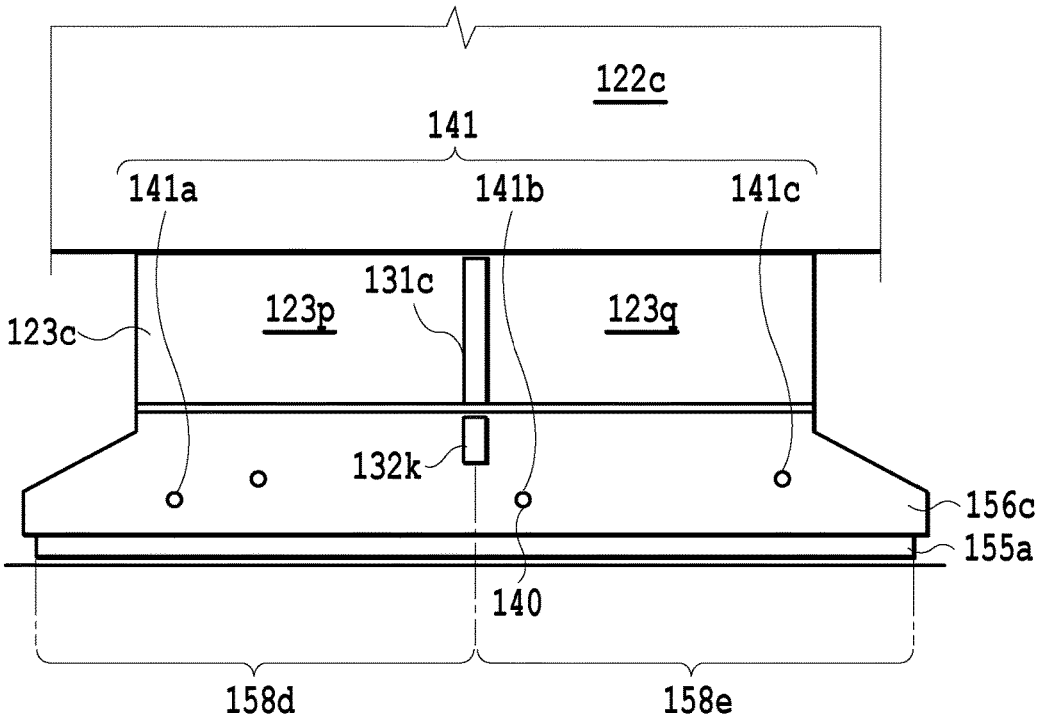
FIG. 5B is a diagram illustrating the flow passage region of the comparative example.

FIG. 5B is for describing a moving state of the small bubbles in the liquid ejection head in the comparative example. At this time, the small bubbles carried by the liquid flow fall downward toward the downstream through the path such as the flow 141. Since a gap between a lower end of the beam-shaped member 131*c* and the beam-shaped member 132*k* is smaller than a space under the beam-shaped member 132*k*, the liquid flow from the left liquid chamber 123*p* to the region 158e moves along a path 141*b* passing through a lower end of the beam-shaped member 132*k*.

In the configuration in which the two beam-shaped members are provided according to the embodiment of the present invention, the small bubbles are distributed in the ejection port arrangement direction, whereas, in the comparative example, a constant flow is generated along the ejection element substrate 155*a* directly under the beam-shaped member 132*k*. A constant ratio of the small bubbles contained in the flow is sucked into the flow toward the ejection port located directly under the beam-shaped member 132*k*, and causes sudden nonejection in the ejection port in the vicinity of the beam-shaped member 132*k*. Since the sudden nonejection concentrates on some regions, visible ejection failures are generated.

Note that the shapes of the one set of the beam-shaped members 132*i* and 132*j* may be different from each other. For example, the vertical length of the deviated-side beam-shaped member 132*i* may be made longer than that of the beam-shaped member 132*j*, and thus flow regulation of the liquid flow from the left liquid chamber 123*p* in which the flow rate is comparatively large may be performed.

Figure 6:
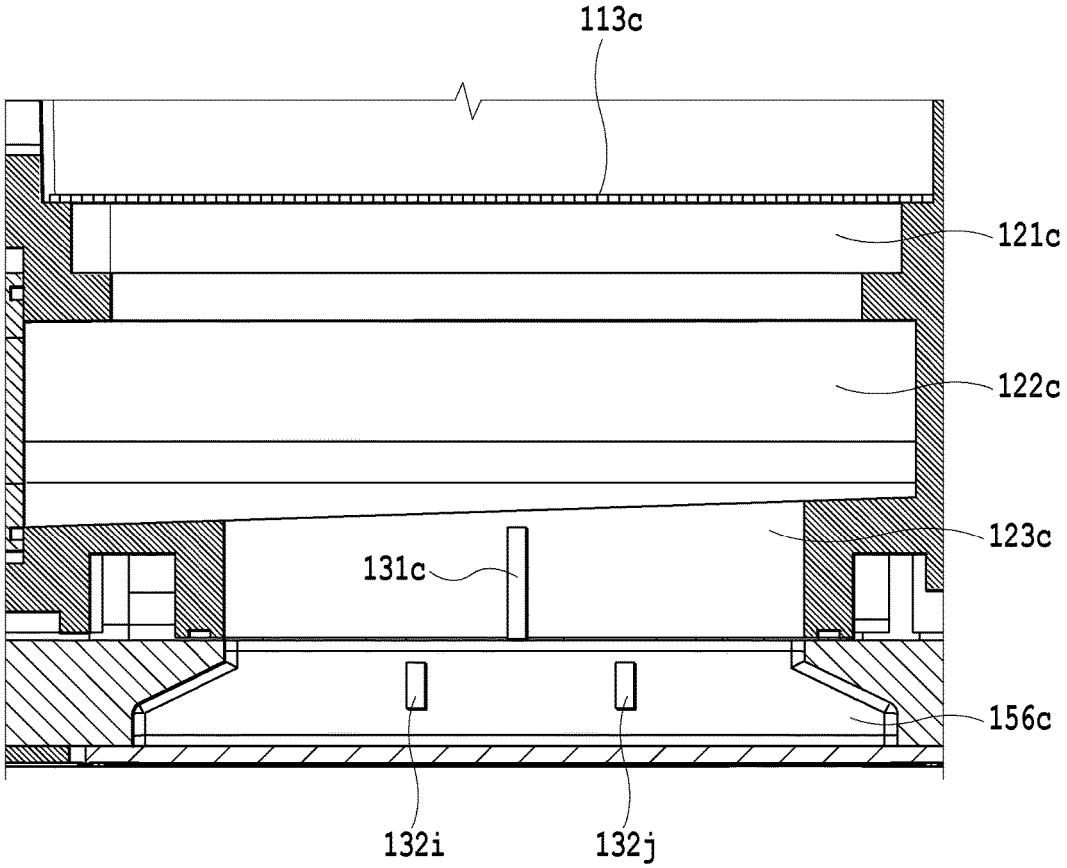
FIG. 6 is a diagram illustrating a modification of the liquid ejection head.

FIG. 6 is a diagram illustrating a modification of the liquid ejection head according to the present embodiment. Although, in the present embodiment, an example of the communication flow passage having a deviated liquid supply structure has been described, the present invention is not limited to the deviated liquid supply structure. For example, even in a long-hole communication flow passage through which the liquid is supplied without deviation as illustrated in FIG. 6, the difference in flow velocity is generated between left and right regions of the beam-shaped member 131*c* depending on the liquid to be ejected. In this case, it is possible to distribute the positions where the small bubbles jump into the ejection ports as in the present embodiment by setting a positional relation among the beam-shaped member 131*c*, the beam-shaped member 132*i* and the beam-shaped member 132*j* as illustrated in FIG. 6.

In this way, the plurality of second beam-shaped members is arranged downstream of the first beam-shaped member which divides the flow passage connected to the ejection element substrate into two flow passages in the liquid-flowing direction so as to sandwich the line extending the first beam-shaped member in the liquid-flowing direction. Accordingly, it becomes possible to achieve the liquid ejection head and the liquid ejection apparatus which make it possible to suppress deterioration of the image quality.

(Other Embodiments)

Hereinafter, other embodiments of the present invention will be described with reference to the drawings. Note that, since the basic configurations of the embodiments are the same as that of the first embodiment, hereinafter, only characteristic configurations will be described.

Figure 7A:
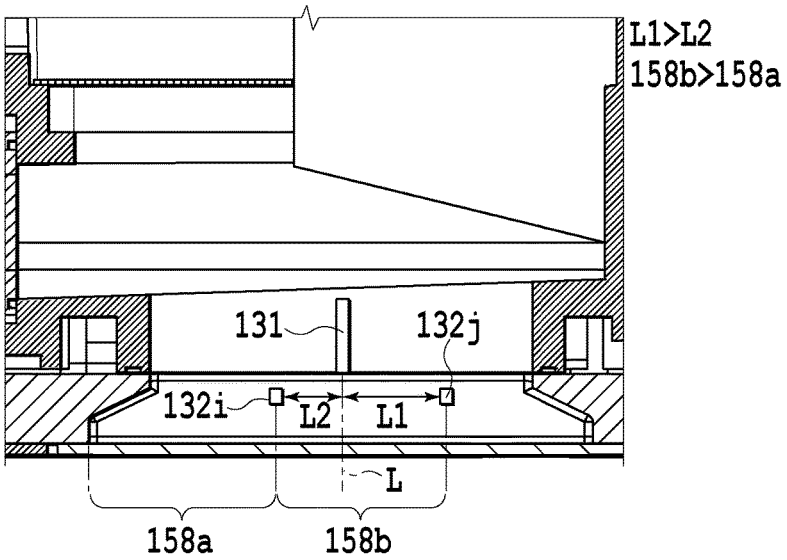
FIG. 7A is a diagram illustrating a flow passage of a liquid ejection head according to another embodiment.
Figure 7B:
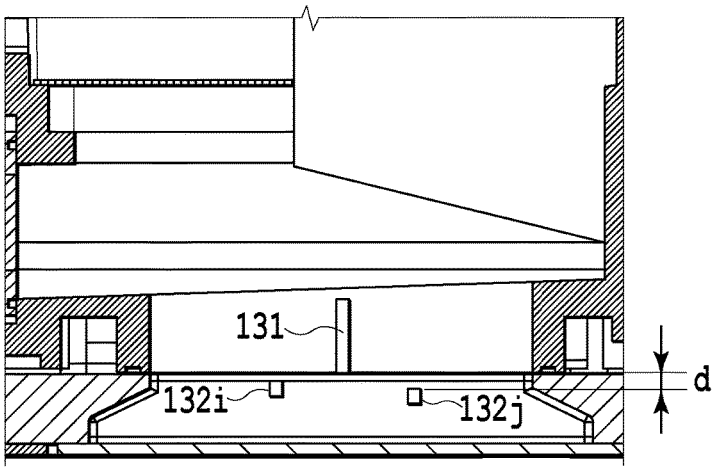
FIG. 7B is a diagram illustrating a flow passage of a liquid ejection head according to another embodiment.
Figure 7C:
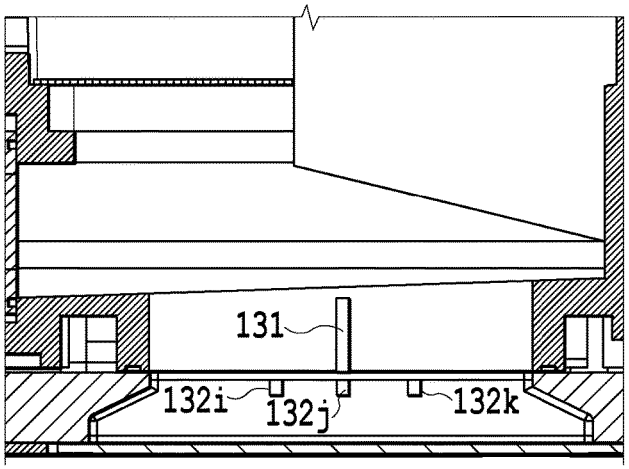
FIG. 7C is a diagram illustrating a flow passage of a liquid ejection head according to another embodiment.

FIG. 7A to FIG. 7C are diagrams illustrating flow passages of liquid ejection heads according to other embodiments of the present invention. FIG. 7A is an example in which the distance L1 between the beam-shaped member 132*j* and the extension line L has been made longer than the distance L2 between the beam-shaped member 132*i* and the extension line L, and thus the region 158*b* has been made wider than the region 158*a*. Accordingly, the difference in flow velocity between the adjacent regions is reduced, and the small bubbles fall downward by being distributed in the three regions, thereby not concentrating on the specific place.

In addition, the positions in the height direction of the beam-shaped members 132*i* and 132*j* may be different from each other. FIG. 7B is an example that a vertical distance d between the lower end of beam-shaped member 131 and the beam-shaped member 132*j* has been made larger than the distance between the lower end of the beam-shaped member 131 and the beam-shaped member 132*i*, and thus an inlet of the liquid from the right liquid chamber 123*q* into the region 158*b* has been made large.

In addition, the beam-shaped member 131 may be shifted to one side of the liquid chamber 123 if there is no hindrance in reinforcement of the flow passage as illustrated in FIG. 7C. At that time, the three beam-shaped members 132*i*, 132*j* and 132*k* are provided in the liquid supply port 156*c* as illustrated in the drawing.

As described above, the plurality of second beam-shaped members is provided on the downstream side of the first beam-shaped member which divides the flow passage into the two flow passages in the liquid-flowing direction so as to sandwich the line extending the first beam-shaped member in the liquid-flowing direction. Accordingly, the difference in flow velocity between the adjacent regions becomes smaller, and the small bubbles fall downward by being distributed to the three regions to thereby not concentrate on the specific place, with the result that it becomes possible to achieve the liquid ejection head and the liquid ejection apparatus which make it possible to suppress deterioration of the image quality.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-107269, filed May 27, 2015, which is hereby incorporated by reference herein in its entirety.

What is claimed is:

1. A liquid ejection head comprising:

an ejection element substrate configured to eject liquid; and a flow passage configured to guide the liquid to the ejection element substrate, wherein the flow passage includes:

a first beam-shaped member configured to divide the flow passage into a plurality of flow passages, and a plurality of second beam-shaped members which are provided on a downstream side of the first beam-shaped member in a liquid-flowing direction so as to sandwich a line extending from the first beam-shaped member in the liquid-flowing direction, wherein the flow passage is divided into two flow passages including a first flow passage and a second flow passage by the first beam-shaped member extending in the liquid-flowing direction, and the first flow passage and the second flow passage are different from each other with respect to velocity at which the liquid flows therethrough.

2. The liquid ejection head according to claim 1, wherein the plurality of second beam-shaped members includes two second beam-shaped members, one of the two second beam-shaped members divides a flow from the first flow passage into two flows and the other of the two second beam-shaped members divides a flow from the second flow passage into two flows.

3. The liquid ejection head according to claim 2, wherein one of the two second beam-shaped members is provided on a downstream side of the other of the two second beam-shaped members in the liquid-flowing direction.

4. The liquid ejection head according to claim 1, wherein the plurality of second beam-shaped members is configured by three second beam-shaped members.

5. A liquid ejection head comprising:

an ejection element substrate configured to eject liquid; and a flow passage configured to guide the liquid to the ejection element substrate, wherein the flow passage, includes:

a first beam-shaped member configured to divide the flow passage into a plurality of flow passages, and a plurality of second beam-shaped members which are provided on a downstream side of the first beam-shaped member in a liquid-flowing direction so as to sandwich a line extending from the first beam-shaped member in the liquid-flowing direction, wherein the plurality of second beam-shaped members includes two second beam-shaped members, one of the two second beam-shaped members divides a flow from the first flow passage into two flows and the other of the two second beam-shaped members divides a flow from the second flow passage into two flows, a flow passage located downstream of the flow passages divided into two by the first beam-shaped member is divided into three regions by the second beam-shaped members, and the region sandwiched by the two second beam-shaped members is a widest region of the three regions.

6. The liquid ejection head according to claim 5, wherein a distance from the other of the two second beam-shaped members to the line extending from the first beam-shaped member in the liquid-flowing direction is longer than a distance from one of the two second beam-shaped members to the line extending from the first beam-shaped member in the liquid-flowing direction.

7. A liquid ejection apparatus capable of mounting a liquid ejection head including an ejection element substrate that ejects liquid and a flow passage configured to guide the liquid to the ejection element substrate, wherein the flow passage includes:

a first beam-shaped member configured to divide the flow passage into a plurality of flow passages, and a plurality of second beam-shaped members which are provided on a downstream side of the first beam-shaped member in a liquid-flowing direction so as to sandwich a line extending from the first beam-shaped member in the liquid-flowing direction, and wherein the flow passage is divided into two flow passages including a first flow passage and a second flow passage by the first beam-shaped member extending in the liquid-flowing direction, and the first flow passage and the second flow passage are different from each other with respect to velocity at which the liquid flows therethrough.

* * * * *